US009359108B2

(12) United States Patent
Leboucher

(10) Patent No.: US 9,359,108 B2
(45) Date of Patent: Jun. 7, 2016

(54) CAN HAVING AN EASY OPENING PANEL, AN EASY OPENING PANEL, AND PANEL THEREFOR

(75) Inventor: Fabrice Leboucher, Angers (FR)

(73) Assignee: Impress Group B.V., Deventer (NL)

( * ) Notice: Subject to any disclaimer, the term of this patent is extended or adjusted under 35 U.S.C. 154(b) by 352 days.

(21) Appl. No.: 12/527,792

(22) PCT Filed: Feb. 28, 2008

(86) PCT No.: PCT/EP2008/001580
§ 371 (c)(1),
(2), (4) Date: Jan. 19, 2010

(87) PCT Pub. No.: WO2008/104392
PCT Pub. Date: Sep. 4, 2008

(65) Prior Publication Data

US 2010/0163560 A1 Jul. 1, 2010

(30) Foreign Application Priority Data

Feb. 28, 2007 (EP) ..... 07075162

(51) Int. Cl.

| | |
|---|---|
| ***B65D 1/12*** | (2006.01) |
| ***B65D 17/32*** | (2006.01) |
| ***B65D 17/00*** | (2006.01) |
| ***B65D 79/00*** | (2006.01) |
| *B65D 17/347* | (2006.01) |

(52) U.S. Cl.
CPC ..... *B65D 17/161* (2013.01); *B65D 79/005* (2013.01); *B65D 2517/007* (2013.01); *B65D 2517/0071* (2013.01); *B65D 2517/0076* (2013.01); *B65D 2517/0077* (2013.01); *B65D 2517/0089* (2013.01)

(58) Field of Classification Search
CPC ..... B65D 17/161; B65D 79/005; B65D 2517/007; B65D 2517/0071; B65D 2517/0076; B65D 2517/0077; B65D 2517/0089
USPC ..... 220/721, 269, 272, 273, 270, 720, 6, 220/756, 766, 763, 765
See application file for complete search history.

(56) References Cited

U.S. PATENT DOCUMENTS

| | | | | |
|---|---|---|---|---|
| 3,938,696 | A * | 2/1976 | Herbst | 220/273 |
| 3,997,075 | A | 12/1976 | Chiappe | |
| 4,017,000 | A * | 4/1977 | Woodley | 220/270 |
| 4,084,721 | A | 4/1978 | Perry | |
| 4,266,688 | A * | 5/1981 | Reid | 220/273 |
| 4,463,866 | A * | 8/1984 | Mandel | 220/269 |
| 4,826,037 | A | 5/1989 | La Croce | |
| 5,147,058 | A * | 9/1992 | Seconde et al. | 220/276 |
| 5,335,808 | A * | 8/1994 | Lee | 220/269 |
| 5,346,087 | A * | 9/1994 | Klein | 220/268 |
| 5,355,808 | A * | 10/1994 | Early | 105/377.01 |
| 5,655,678 | A * | 8/1997 | Kobayashi | 220/269 |
| 5,725,120 | A * | 3/1998 | Ramsey et al. | 220/276 |
| 5,804,237 | A * | 9/1998 | Diamond et al. | 426/131 |
| 2002/0172578 | A1 * | 11/2002 | Heinicke et al. | 413/67 |

(Continued)

*Primary Examiner* — J. Gregory Pickett
*Assistant Examiner* — Niki Eloshway
(74) *Attorney, Agent, or Firm* — The Webb Law Firm

(57) ABSTRACT

The invention relates to a can having an easy opening panel comprising a tab connected via a rivet structure to the panel, wherein the tab comprises a tab rear part for gripping and actuation, and a tab front part for opening the can upon tab actuation, wherein the panel comprises at least beneath the tab front part a panel structure deformable upon can internal pressure.

17 Claims, 6 Drawing Sheets

(56) References Cited

U.S. PATENT DOCUMENTS

2003/0116570 A1* 6/2003 Olson et al. ..... 220/270
2005/0284869 A1* 12/2005 Mills ..... 220/269
2007/0108209 A1* 5/2007 Jeon ..... 220/269
2009/0261099 A1* 10/2009 Jongsma et al. ..... 220/213
2010/0059530 A1* 3/2010 Niec et al. ..... 220/623

* cited by examiner

CAN HAVING AN EASY OPENING PANEL, AN EASY OPENING PANEL, AND PANEL THEREFOR

BACKGROUND OF THE INVENTION

1) Field of the Invention

The present invention relates to a can having an easy opening panel, to an easy opening panel for such can, and a panel for an easy opening panel.

2) Description of Related Art

An easy opening can is a can provided with an easy opening panel. Such easy opening panel comprises a tab connected via a rivet structure to the panel. The tab comprises a tab rear part for gripping by the consumer. The tab is actuated by levering the tab whereby a tab front part contacts the panel. The panel is provided with an opening defined along a score line which is provided in the panel. After popping the score line the can is provided in the panel with an opening along the score line and eventually the central part within the score line may be torn off using the tab. Accordingly, an easy opening can is a can which may be opened without the need of using a separate tool.

The can may be filled and subsequently closed by seaming or soldering the easy opening panel onto a can rim. Subsequently, the filled easy opening can may be subjected to a heating or cooking process. The temperature increase of the can content will result in an increase of the can internal pressure and an increase of the volume of the content of the can. The can internal pressure will result in a deformation of the easy opening panel. The easy opening panel will deform into a bulging or convex shape. The tab connected to the easy opening panel will change position relative to the can, and in particular relative to the can rim. The tab rear part will extend outwardly and beyond the can rim over a relatively large distance.

The outwardly projected tab rear part may contact machine components of the cooking apparatus, such as the rails of a rotary cooker or may contact the bottom of neighbouring cans. This will result in a tab scuffing and even actuation of the tab and thereby opening of the can. The latter will result in a release of the can content and a contamination of the cooking apparatus. This will interfere with the production speed of the filled cans.

SUMMARY OF THE INVENTION

The objective of the present invention is to avoid as much as possible an interference of filled easy opening cans with the production process, in particular during the cooking of the filled easy opening cans in a cooking apparatus and during subsequent further handling. However, at the same time it should be avoided that any changes in relation to the easy opening can may not result in an interference with the finger gripping and easy opening of the filled can by the consumer. In particular may not result in relation to a decrease in the access of the tab rear part or no increase in relation to the forces required for popping and opening the easy opening can.

The present invention is based on the insight that the undesired excessive tab lift as result of an temporary internal pressure may be reduced and even minimized by including in the easy opening panel a panel structure which will deform upon can internal pressure such that the tab lift beyond the easy opening can rim is reduced to within practical limits. It is even possible within the scope of the invention that after relief of the internal can pressure the panel structure reforms into a position in which the tab is lying within the (hypothetical) envelop of the can rim.

Accordingly, the present invention provides a can having an easy opening panel comprising tab connected via a rivet structure to the panel, wherein the tab comprises a tab rear part for gripping and actuation, and a tab front part for opening the can upon tab actuation, wherein the panel comprises at least beneath the tab front part a panel structure deformable upon can internal pressure.

Due to the presence of a panel structure deformable upon can internal pressure this structure will compensate (at least partly) to a pressure induced deformation into a convex, bulging or dome shape of the easy opening panel. By this compensation an inclination angle of the rivet base is less or not increased. Essentially, the panel structure deforms by compensation for the stress induced by the increased can internal pressure thereby such that the rising of the tab rear part is reduced. The deformable panel structure may even have a compressed structure intended to compensate for the stress elongation upon increased can internal pressure.

The deformable panel structure according to the invention is at least to be located beneath the tab front part and in between the rivet structure and the can rim.

Obviously, the deformable panel structure according to the invention may have various different structural forms, such as a dimple, bead, wavy or slanted form.

According to one embodiment the deformable panel structure has the form of a bead partly circumventing the rivet structure. Obviously, due to the increased can internal pressure the bead form may be lost temporarily but subsequently reformed at least partly.

According to a preferred embodiment according to the present invention the deformable panel bead structure extends inwardly or outwardly. Such bead may be formed into the easy opening panel using traditional tooling and will not interfere with the traditional manufacturing processes for an easy opening panel. The beads may extend inwardly or outwardly. The beads may extend circumferentially around the rivet structure sufficiently as to compensate for the reduction in tab lift. For instance the bead may extend circumferentially over upon 270°. Under particular circumstances the bead may circumferentially extend over 180° or even only over 120°. It is for the skilled person on the basis of routine experimentation to determine the circumferential extension of the bead. The circumferential extension may be over 30-270°, such as 60-270°, more in particular 90-270°. Obviously, similar ranges could be considered by the skilled person such as 30-180°, 30-120° and any suitable upper limit in between.

The rising of the tab during cooking should be reduced such that there is not interference with the cooking apparatus. Generally, a tab lift to less than 4 mm beyond the can rim is allowable. More preferably and at lower risks the tab lift is less than 3.5 mm, or even less than 3.0 mm. Obviously, the tab lift may be subjective to the residing can internal pressure. Such pressures may be within the range of 0.6-3.0 bar, preferably within the range of 1.0-2.8 bar, such as more preferably 1.5-2.5 bar, such as at a diameter of 73 mm at 1.5-2.5 bar less than 2.5 mm. Clearly, dependent on the form of the easy opening panel and the applied deformable panel structure according to the invention it is routine experimentation for the skilled person to determine in relation to expected internal pressures during cooking to what extent a reduced tab rising is allowable.

Finally, it is noted that the tab rising is in particular relevant in relation to can diameters within the range of 32-120 mm, or preferably for can within the range of 45-102 mm, such as more preferably cans having a diameter of 45-96 mm.

It is a preferred feature of the deformable panel structure of the easy opening panel according to the invention that after relief of the can internal pressure (that is after cooking treatment and cooling) the deformable structure reforms to a structure, preferably its original structure, but at least a structure such that the tab rear part resides within the can rim and has a position relative to the easy opening can that allows the consumer easy gripping and easy opening of the panel.

According to a preferred embodiment the deformation of the panel structure beneath the tab front part forms or increases a finger access gap between the tab rear part and the panel. After closing and processing of the easy opening can the internal pressure is to a major extent relieved. However, there may be a slight pressure difference between the outside and content of the can. This pressure difference will be negative after a processing including closure of the easy opening can comprising hot content. The design of the panel structure (form and/or the wall thickness) is such that due to this pressure difference the panel structure beneath the tab front part is deformed or remains deformed such that the tab rear part will move upwardly or stays in an elevated position thereby providing or maintaining a space between the tab rear part and the panel for providing or increasing the finger access. Thus, the finger access at the tab rear part is improved. According to a preferred embodiment this finger access results from the negative pressure difference between the outside and content of the can. Such inward movement may result from a negative pressure difference of −0.1 to −0.9 bar, preferably −0.2 to −0.5 bar, such as −0.3 bar.

Under circumstances it is preferred that the finger access formation or increase results from a mechanical impact. Accordingly by a negative pressure difference and/or by mechanical impact the finger access is formed or improved. Obviously, by application of this mechanical impact the pressure difference may be negative (as defined above), may be zero or slightly positive up to about 0.5 bar.

After opening of the easy opening can the panel may stay in this position. However, it is possible that the easy opening panel may go back to its original position or any intermediate position. A situation in which the finger access is no longer of major importance.

Another aspect of the present invention relates to an easy opening panel to be seamed or soldered to a can. Such can comprises a tab connected via a rivet structure to the panel and has the deformable panel structure of the invention and described above.

Finally, according to another aspect the invention relates to a panel for the easy opening panel. This panel comprises the panel structure deformable upon can internal pressure but is still to be applied with a rivet structure.

BRIEF DESCRIPTION OF THE DRAWINGS

Mentioned and other features of the easy opening can, easy opening panel and panel therefore will be further illustrated by various embodiments given for illustrative purposes and not intended to limit the present invention to any extent. These embodiments according to the invention are illustrated in the following figures, wherein.

DETAILED DESCRIPTION OF THE PREFERRED EMBODIMENTS

Figure 1:
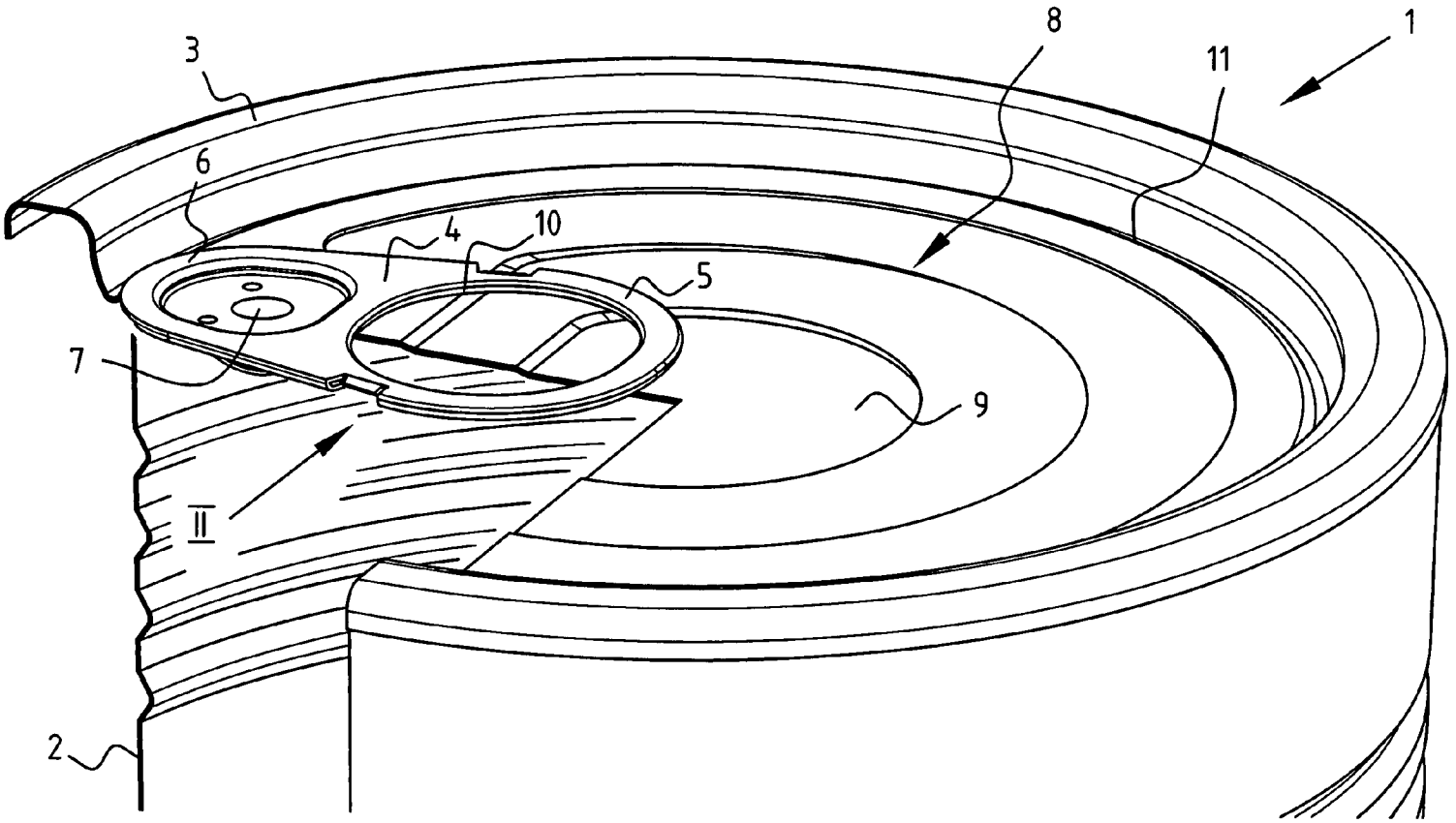
FIG. 1 a partly broken perspective view of a can provided with an easy opening panel.

FIG. 1 shows a can 1. The can 1 comprises a body 2 provided with an easy opening panel 3. The panel 3 comprises a tab 4 having a tab rear part 5 and a tab front part 6. The tab 4 is connected to the panel 3 via a rivet structure 7.

The panel 3 is provided with a central terrace type of structure 8. Between the central structure 9 and the tab rear part 5 is available a space accessible for a finger of the user. By gripping the tab rear parts at or in the tab opening 10 and levering or tilting the tab 4 will result in opening the panel 3 along a score line 11. Accordingly, the can 1 or panel 3 may be opened by actuating the tab 4 without the need of a separate tool.

Figure 2A:
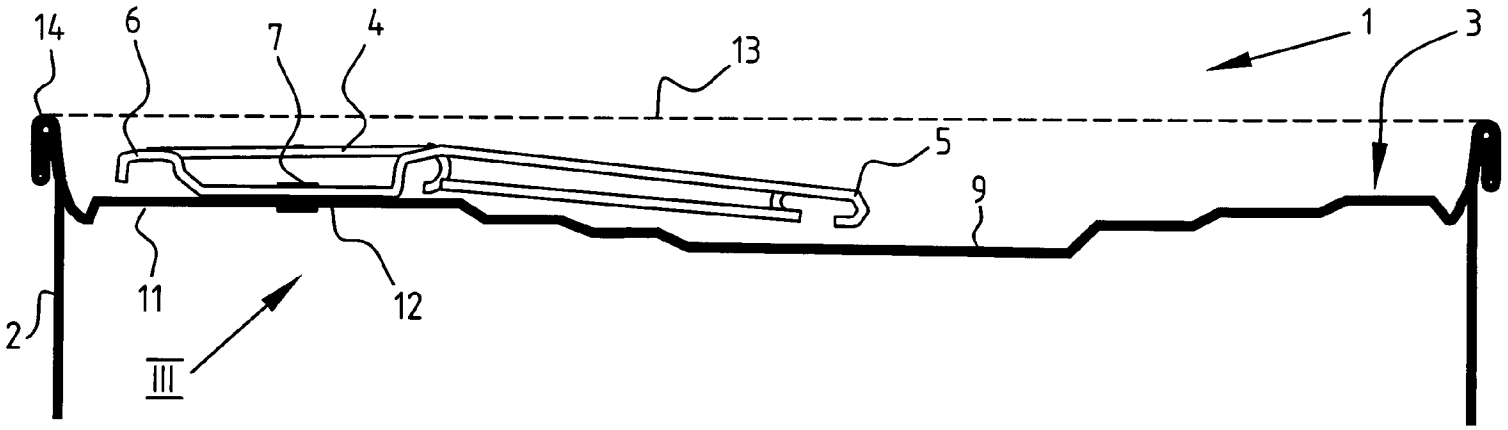
FIG. 2A (PRIOR ART)
FIGS. 2A and 2B a cross-sectional view according to arrow II in FIG. 1, showing an easy opening can according to the prior art at normal can internal pressure (FIG. 2A) and at increased can internal pressure (FIG. 2B)
Figure 2B:
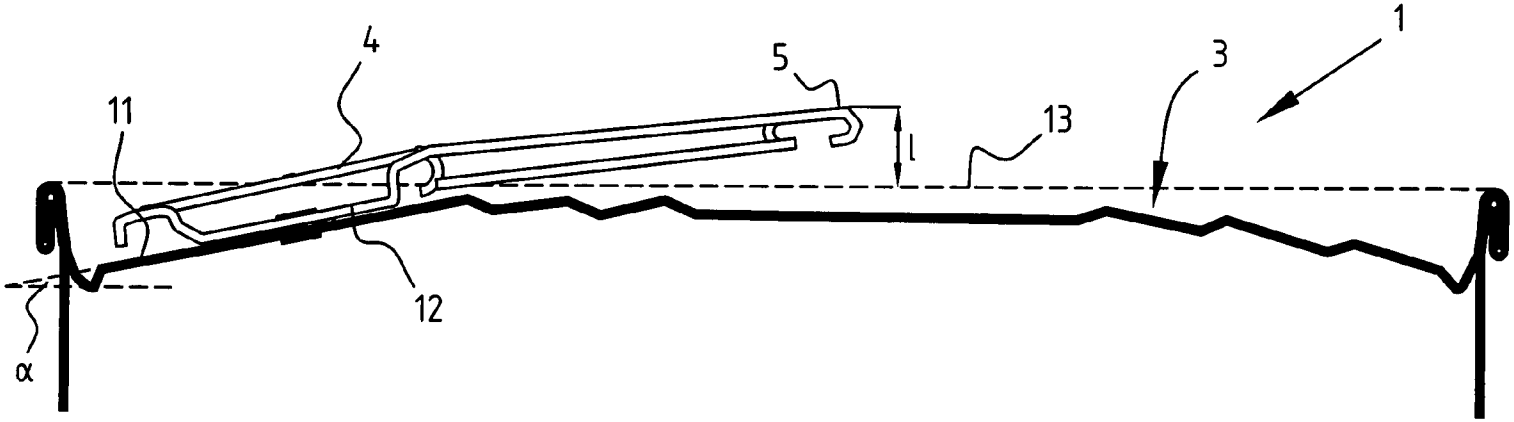
FIG. 2B (PRIOR ART)

FIGS. 2A and 2B show more in detail the prior art structure illustrated in FIG. 1.

The tab 4 is connected to the panel 3 via a rivet structure 7. The base 12 for the tab 4 has a substantially horizontal position. The tab rear part 5 resides within an hypothetical envelope 13 formed by the rim 14 of the can 1.

FIG. 2B shows the situation during cooking the can 1 whereby the internal pressure is increased due to the temperature rise and thereby a volume increase. The result is that the base 12 takes a more inclined position having an angle alpha. The tab 4 will also take a more inclined position such that the tab rear part 5 with a tab lift 1 extends beyond the envelope 13.

Figure 3B:
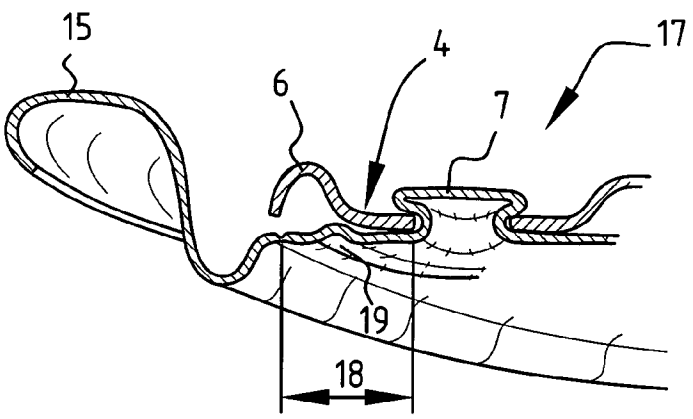
FIGS. 3B-3H embodiments of easy opening panels provided with a deformable panel structure according to the invention.
Figure 3D:
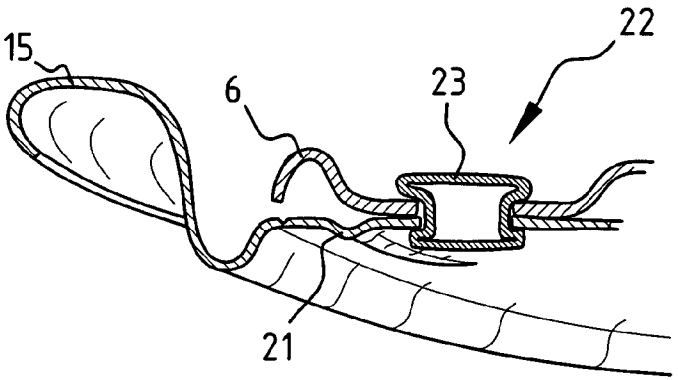
Figure 3A:
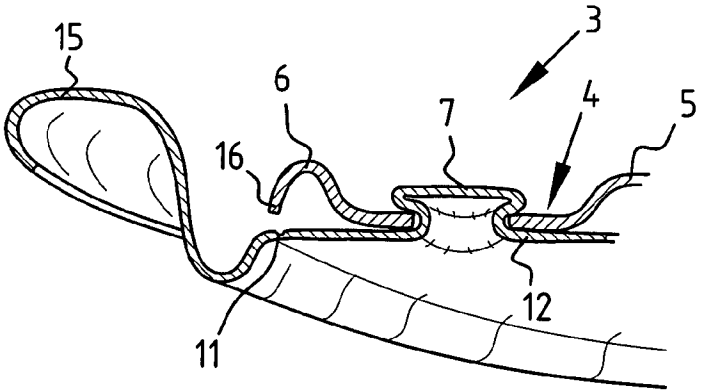
FIG. 3A (PRIOR ART)
FIG. 3A a detail according to arrow III of FIG. 2A.

FIG. 3A shows in cross-section the easy opening panel 3. The panel 3 comprises a curl 15 to be seamed on the body 2. The tab 4 is connected via a rivet structure (formed from material of the central part of the panel 3) to the panel at a base 12. The free end 16 of the tab front part 6 is to contact during actuation and tilting of the tab 4 the score line 11 for popping and eventual opening.

FIG. 3B shows a panel 17 according to the invention comprising a tab 4 connected via a rivet structure 7 to the panel 17. The area 18 beneath the tab front part 6 and between the rivet structure 7 and curl 15 is provided with a panel structure 19 which is deformable upon can internal pressure. This deformable panel structure 19 has the form of an outwardly extended bead encircling the rivet structure 17 over about 160-200°.

Figure 3C:
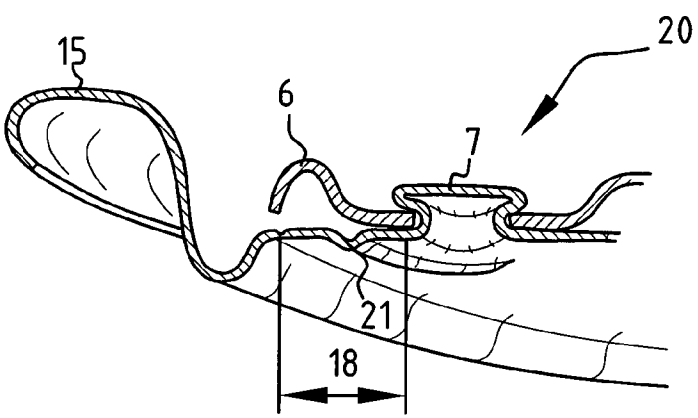

FIG. 3C shows another easy opening panel 20 according to the invention. The panel 20 comprises beneath the tab front part 6 and between the rivet structure 7 and the rim 15 a panel structure 21 which is deformable upon can internal pressure. This structure 21 has the form of an inwardly directed bead encircling the rivet structure 7 over about 170-240°.

FIG. 3D shows another easy opening panel 22 according to the invention comprising the same deformable panel structure 21 as the easy opening panel 20 illustrated in FIG. 3C. In this case the rivet structure 7 is having the form of a separate rivet 23. Furthermore, the deformable panel structure 21 extends circumferentially over about 120-180° around the rivet 23.

Figure 3F:
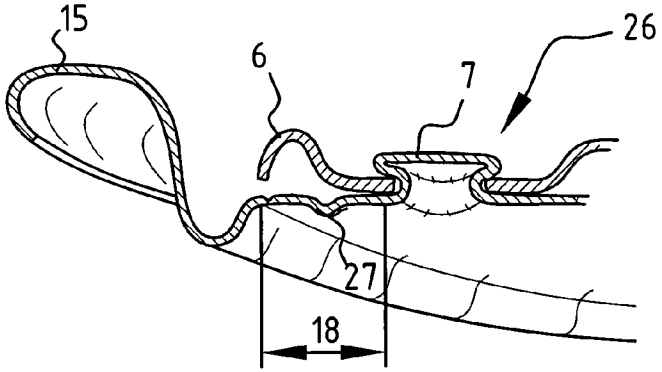
Figure 3E:
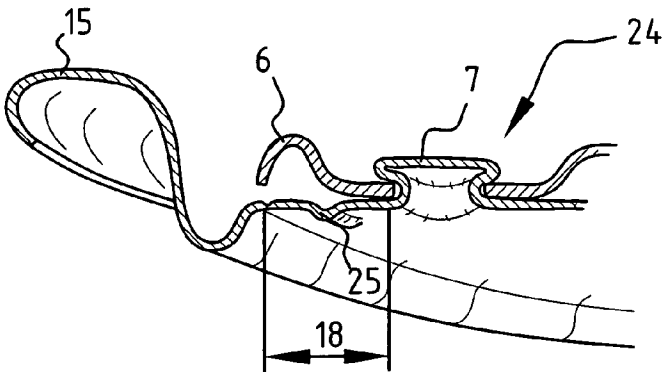

FIG. 3E shows a panel 24 according to the invention having a similar structure as shown in FIGS. 3C and 3D. However, in the area 18 the inwardly directed bead 25 forms the deformable panel structure according to the invention and extends over about 20-40° around the rivet structure 7.

FIG. 3F shows another panel 26 according to the invention. In the area 18 beneath the tab front part 6 and between the rivet structure 7 and the curl 15 the deformable panel structure 27 has the form of an inwardly directed dimple 27.

Figure 3H:
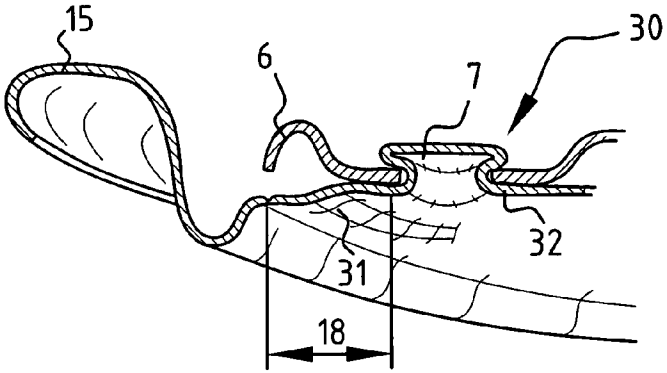
Figure 3G:
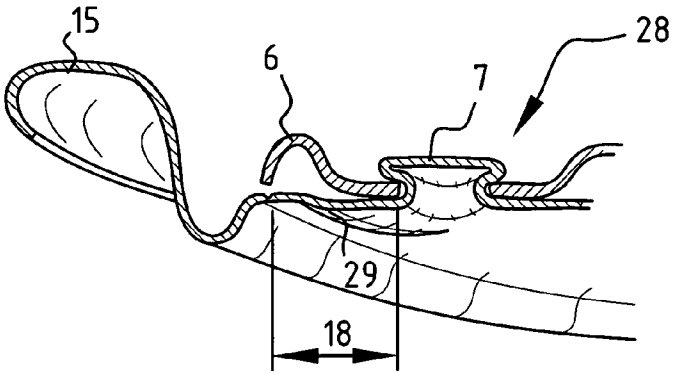

FIG. 3G shows another panel 28 according to the invention. In the area 18 beneath the tab front part 6 and in between the rivet structure 7 and curl 15 is a so called compressed panel structure having a slanted or slightly wavy form. This structure 29 is able to elongate upon stress generated by increase internal can pressure. This structure 29 extends around the rivet structure 7 over about 130-190°. The structure 29 is slightly directed inwardly.

FIG. 3H shows a panel 30 according to the invention having in the area 18 beneath the tab front part 6 and in between the rivet structure 7 and curl 15 a structure 31 extending slightly outwardly and forming a compressed panel section. Upon increased can internal pressure and volume increase the deformation of the panel may be compensated by this compressed structure 31 by elongation thereby avoiding or reducing the inclination of the panel base 32 thereby minimizing or reducing the tab lift.

Figure 4A:
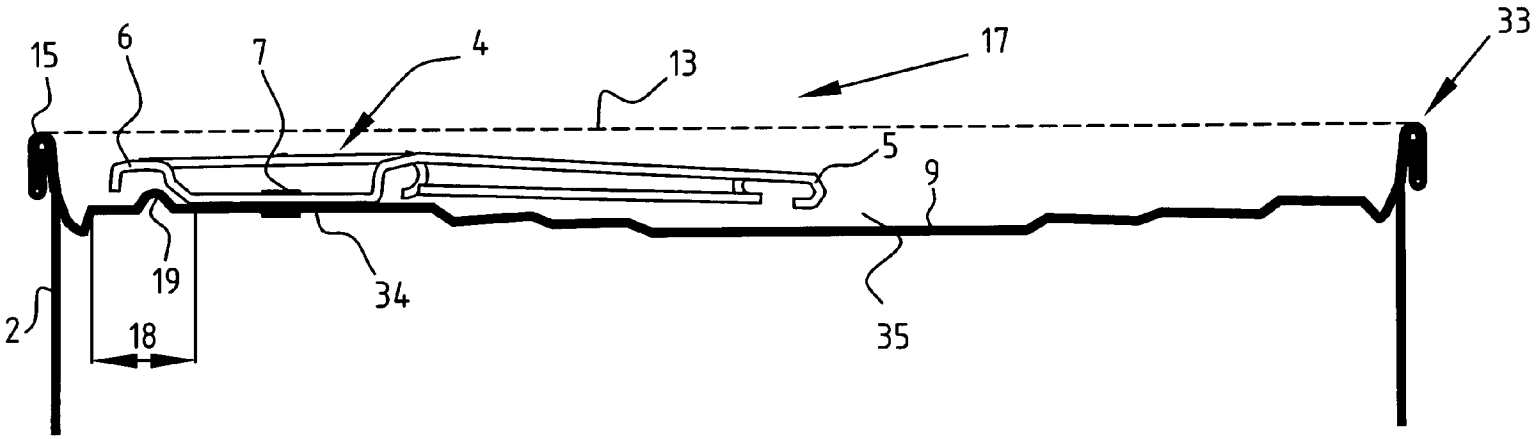
FIGS. 4A and 4B at larger scale the easy opening panel according to FIG. 3B seamed to a can at normal can internal pressure (FIG. 4A) and at increased can internal pressure (FIG. 4B)
Figure 4B:
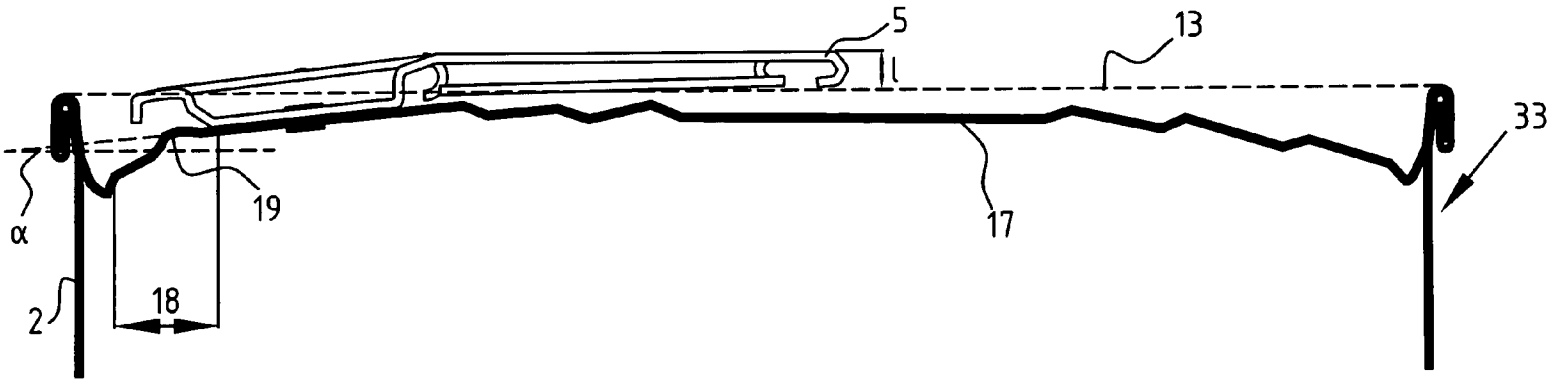

FIGS. 4A and 4B show the effect for panel 17 of the deformable panel structure 19 in reaction to an increase of can internal pressure. This panel 17 is further described in relation to FIG. 3B.

FIG. 4A shows the easy opening can 33 according to the invention provided with the easy opening panel 17. The base 34 to which the tab 4 is connected has a substantially horizontal position. In between the base 34 and the curl 15 is the outwardly extending bead 19 within the area 18. The free end 5 lies within the hypothetical envelope 13. At the same time there is a free space 35 in between the central area 9 of the panel 17 and the tab rear part 5. Accordingly, this tab rear part 5 can be easily gripped and tilted for opening the easy opening can 33.

Figure 5A:
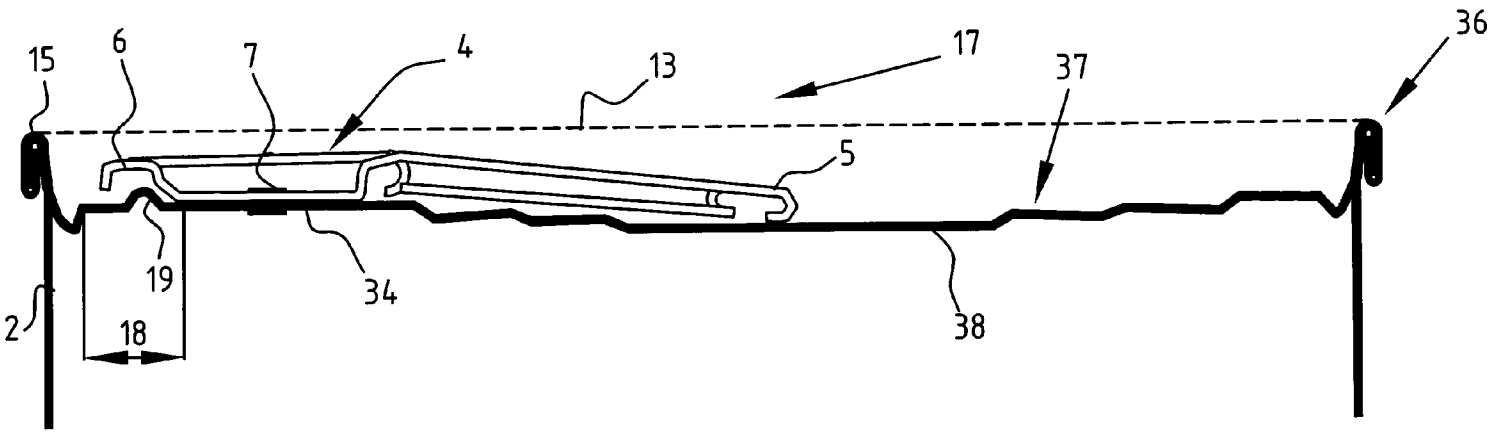
FIGS. 5A and 5B show another embodiment comprising the additional functionality of finger access improvement.

FIG. 5A shows a can 36 having an easy opening panel 37 connected via a curl 15 to the body 2 at substantially no pressure difference. The rear tab part 5 of the tab 4 is contacting or almost contacting a central panel part 38 which is residing at least partly beneath the tab rear part 5.

Upon generation of a negative pressure (due to cooling of the hot content) of about −0.2 to −0.5 bar, such as −0.3 bar between the outside and the content of the can 36 the panel structure 19 becomes deformed. Also the central panel part 38 moved by deformation inwardly. These deformations result in the formation or an increase of a gap 39 (see FIG. 5B). This gap 39 improves the finger access of the tab 5 for the consumer intending to open the can 36. If not spontaneous the formation of the finger access gap 39 may be urged using a tool contacting the panel structure 19 temporarily and push the tab front part 6 downwardly and/or pull the tab rear part 5 upwardly.

It is noted that at a slight positive or zero pressure difference between the outside and the content of the can 36, the tab rear part 5 may be urged to move upwardly by mechanical impact using the mechanical pusher or equivalent mechanical tool. An impact preferably taking place in the area 18.

Figure 5B:
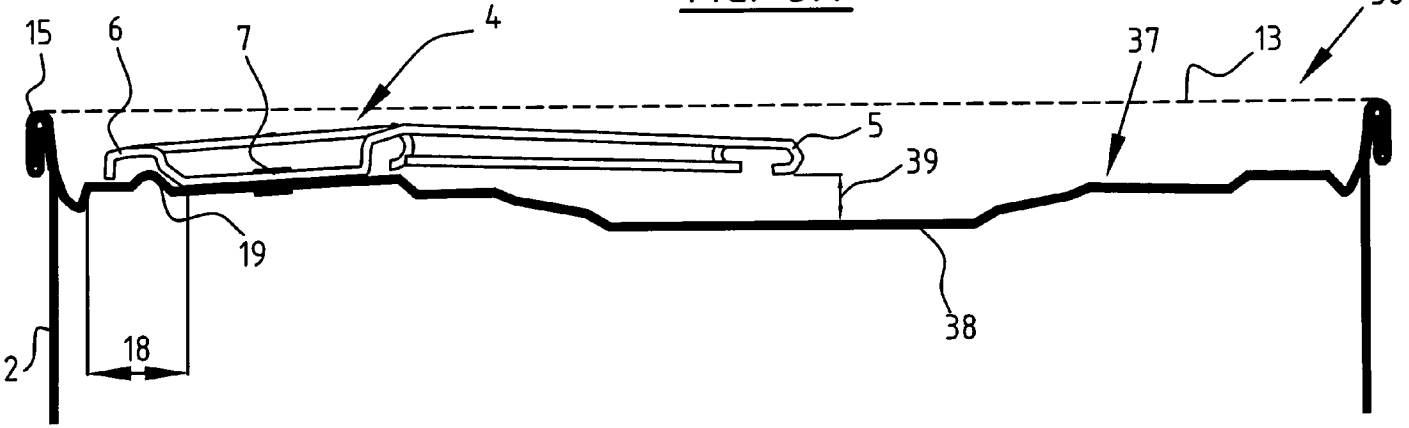

After opening of the can 36 by actuating the tab after finger access gripping the tab rear part 5, which opening resulted in relieve the negative pressure difference, the easy opening panel 37 may stay in the form illustrated by FIG. 5B or may return into the form illustrated by FIG. 5A. It is noted that due to a negative pressure difference over the can, the central panel part 38 may move to some extent inwardly, thereby contributing to the provision of the finger access.

During and shortly after cooking of the content of the closed can 33 due to internal pressure rise and volume rise the panel 17 deforms into a bulging, convex, or dome shape. At a constant diameter of the body 2 this bulging or convexity results in an deformation of the panel 17. However, this deformation in at least the area 18 results in a deformation of the bead 19 into a less curved and more smoothly structure 19 thereby at least partly compensating for the deformation. As a result the inclination angle alpha is less than according to the prior art (see FIG. 2B). Accordingly, the tab lift 1 is far less than according to the prior art (FIG. 2B).

It will be apparent to the skilled person that the other structures shown in FIGS. 3B-3H will all have a similar effect upon increase of the can internal pressure and the concomitant volume rise. The deformable panel structures according to the invention will deform thereby minimizing the panel lift 1 and thereby avoiding an excessive projection of the tab rear part beyond the hypothetical envelope 13 formed by the can rim.

For practical reasons limits have been set to the allowable tab lift 1. Generally, the tab lift should be less than 4 mm, and preferably less than 3.5 mm, such as less than 3.0 mm. In a practical example the tab lift was less than 2.0 mm at an internal pressure of about 2.5-3.0 bar. In other types of easy opening cans of 65, 73, 83 and 99 mm in diameter at pressures of 2.5-3.0 bar a range for the tab-lift was in the range of 1.5-4 mm.

The panel lift 1 is also dependent on the can diameters which could be within the given ranges of 32-120 mm. Most practically the panel lift should be reduced for cans within the range for a diameter of in between 45-102 mm, such as 45-99 mm.

The deformable structures are essentially such that preferably also the deformed panel structure reforms to a shape after relief of the can internal pressure so that the tab rear part resides again within the hypothetical envelope 13 and that is between the can rim or curl 15.

The can could be made of metal such as steel and aluminium. The can may be inwardly coated with plastic or lacquer dependent on the can content which is to be cooked prior to selling and use by the consumer.

Reading the above description it will be apparent to the skilled person that the easy opening can with the deformable panel structure will maintain its traditional manufacturing properties while use by the consumer is not hampered and that the forces required to opening the can have not been adversely affected. Finally, it is relevant that the easy opening can maintains its diameter, e.g., the unit depth and panel depth for reasons that these structural can elements influence the distance of the tab relative to the can rim.

The invention claimed is:

1. A can having an easy opening panel, comprising: a tab connected via a rivet structure to the panel, wherein the tab comprises a tab rear part for gripping and actuation, and a tab front part for opening the can upon tab actuation such that tilting of the tab results in opening of the can along a score line formed in the panel, wherein the panel comprises, at least beneath the tab front part, a deformable, compressed panel structure deformable upon an increase in can internal pressure, wherein the deformable, compressed panel structure is located beneath the tab front part, wherein the deformable, compressed panel structure includes a compressed structure that compensates for stress elongation upon increased can internal pressure, wherein the deformation of the deformable, compressed panel structure by stress elongation of the deformable, compressed panel structure beneath the tab front part forms or increases a finger access gap between the tab rear part and the panel, and does not result in an interference of an opening of the can by a consumer actuating the tab, wherein the deformable, compressed panel structure has the form of a bead partly circumventing or encircling the rivet structure, and wherein the stress elongation of the deformable, compressed panel is caused by increased can internal pressure.

2. The can according to claim 1, wherein the deformable, compressed panel structure bead extends inwardly or outwardly.

3. The can according to claim 1, wherein the deformable, compressed panel structure bead circumferentially extends over one of 270°, 180°, and 120°.

4. The can according to claim 1, wherein the deformable, compressed panel structure limits upon can internal pressure the tab lift of the tab rear part to less than 4 mm above a can rim.

5. The can according to claim 4, wherein limitation of the tab lift occurs at a can internal pressure of 0.6-3.0 bar.

6. The can according to claim 4, wherein limitation of the tab lift occurs at a can internal pressure of 1.0-2.8 bar.

7. The can according to claim 4, wherein limitation of the tab lift occurs at a can internal pressure of 1.5-2.5 bar.

8. The can according to claim 1, wherein the can has a can diameter of 32-120 mm.

9. The can according to claim 1, wherein upon partial relief of the can internal pressure the deformable, compressed panel structure reforms such that the tab rear part resides beneath a can rim.

10. The can according to claim 1, wherein the formation or increase of the finger access gap results from a negative pressure difference between the outside and content of the can.

11. The can according to claim 1, wherein the formation or increase of the finger access gap results from a mechanical impact on the deformable, compressed panel structure.

12. The can according to claim 1, wherein the deformable, compressed panel structure limits upon can internal pressure the tab lift of the tab rear part to less than 3.5 mm above a can rim.

13. The can according to claim 1, wherein the deformable panel structure limits upon can internal pressure the tab lift of the tab rear part to less than 3.0 mm above a can rim.

14. The can according to claim 1, wherein the can has a can diameter of 45-102 mm.

15. The can according to claim 1, wherein the can has a can diameter of 45-96 mm.

16. An easy opening panel comprising a tab connected via a rivet structure to the panel, wherein the tab comprises a tab rear part for gripping and actuation, and a tab front part for opening the can upon tab actuation such that tilting of the tab results in opening of the can along a score line formed in the panel, wherein the panel comprises, at least beneath the tab front part, a deformable, compressed panel structure deformable upon an increase in can internal pressure, wherein the deformable, compressed panel structure is located beneath the tab front part, wherein the deformable, compressed panel structure includes a compressed structure that compensates for stress elongation upon increased can internal pressure, wherein the deformation of the deformable, compressed panel structure by stress elongation of the deformable, compressed panel structure beneath the tab front part forms or increases a finger access gap between the tab rear part and the panel, and does not result in an interference of an opening of the can by a consumer actuating the tab, wherein the deformable, compressed panel structure has the form of a bead partly circumventing or encircling the rivet structure, and wherein the stress elongation of the deformable, compressed panel is caused by increased can internal pressure.

17. A panel for a can, the panel comprising a tab connected via a rivet structure to the panel and a deformable, compressed panel structure deformable upon can internal pressure, wherein the tab comprises a tab rear part for gripping and actuation, and a tab front part for opening the can upon tab actuation such that tilting of the tab results in opening of the can along a score line formed in the panel, wherein the panel comprises, at least beneath the tab front part, the deformable, compressed panel structure, wherein the deformable, compressed panel structure is located beneath the tab front part, wherein the deformable, compressed panel structure includes a compressed structure that compensates for stress elongation upon increased can internal pressure, wherein the deformation of the deformable, compressed panel structure by stress elongation of the deformable, compressed panel structure beneath the tab front part forms or increases a finger access gap between the tab rear part and the panel, and does not result in an interference of an opening of the can by a consumer actuating the tab, wherein the deformable, compressed panel structure has the form of a bead partly circumventing or encircling the rivet structure, wherein the stress elongation of the deformable, compressed panel is caused by increased can internal pressure, and wherein upon partial relief of the can internal pressure the deformable, compressed panel structure reforms such that the tab rear part resides beneath a can rim.

* * * * *